US006826938B2

(12) United States Patent
Huang

(10) Patent No.: US 6,826,938 B2
(45) Date of Patent: Dec. 7, 2004

(54) KEY COLLECTING DEVICE CONTROLLED ON ONE END

(76) Inventor: Yu-Hwei Huang, No. 8, Lane 42, Sec. 2, Nan-Kan Road, Lou-Choo Hsiang, Tao-Yuan Hsien (TW)

( * ) Notice: Subject to any disclaimer, the term of this patent is extended or adjusted under 35 U.S.C. 154(b) by 14 days.

(21) Appl. No.: 10/324,020

(22) Filed: Dec. 20, 2002

(65) Prior Publication Data

US 2004/0118173 A1 Jun. 24, 2004

(51) Int. Cl.[7] ..... E05B 15/00
(52) U.S. Cl. ..... 70/456 R; 70/459
(58) Field of Search ..... 70/456 R, 459, 70/456 B; 24/3.6

(56) References Cited

U.S. PATENT DOCUMENTS 2,307,808 A * 1/1943 Segal ..... 24/600.6
4,324,121 A * 4/1982 Richter ..... 70/459
4,407,148 A * 10/1983 Rousseau ..... 70/456 R
4,741,189 A * 5/1988 Battenberg ..... 70/456 R
4,821,543 A * 4/1989 Scungio ..... 70/456 R
5,477,714 A * 12/1995 Bishop ..... 70/459
5,685,185 A * 11/1997 MacDonald ..... 70/459
5,752,401 A * 5/1998 MacDonald ..... 70/459
6,003,352 A * 12/1999 Yu ..... 70/459
6,006,562 A * 12/1999 Wolter ..... 70/456 R

* cited by examiner

*Primary Examiner*—John B. Walsh
(74) *Attorney, Agent, or Firm*—Troxell Law Office PLLC

(57) ABSTRACT

The key collecting device being controlled on one end has a main body which is provided with a movable latch positioned normally by extending and abutting of an elastic member. A transverse hole with a specific diameter extends through the main body for connecting and mounting an annular ring having a notch for mounting and detaching of keys. The movable latch is provided with a through hole having a size same as that of the transverse hole, the through hole normally is under pressure to get out of the way of the transverse hole but get in the notch of the annular ring, so that partial length of the movable latch is exposed out of the end surface of the main body for controlling by pressing.

2 Claims, 11 Drawing Sheets

KEY COLLECTING DEVICE CONTROLLED ON ONE END

BACKGROUND OF THE INVENTION

1. Field of the Invention

The present invention is related to a key collecting device being controlled on one end thereof, and especially to a key collecting device making loading and detaching of keys and some accessories in and from it faster, and manufacturing of it can be more inexpensive and convenient.

2. Description of the Prior Art

In living at home, working at working sites or being on vehicles for going outside in our modern lives, we use various keys; and we carry key collecting devices on our own persons as necessary articles for collecting and tidying keys in use in a convenient way.

Earlier key collecting devices are comprised each of a twin layer annular ring with a notch in order that keys provided with holes can be inserted onto the twin layer annular ring one by one. Such conventional key collecting devices are quite troublesome, hard and inconvenient no matter in inserting in or taking out keys.

Key collecting devices in the recent years, taking the U.S. Pat. No. 4,584,858 as an example, largely improved the convenience of use of the key collecting devices; principally, it is provided near the center of a disk surface having a peripheral annular groove with a control knob which links up with an engaging latch provided in the disk. So that the engaging latch normally seals a notch provided in the peripheral annular groove, the notch is opened when the control knob pulls it to retract inwardly. Keys can be connected with a connecting piece with a ball like end in advance, so that the ball like end of the connecting piece can be mounted in or detached from the disk via the notch. In this way, mounting and detaching of the keys in and from a key collecting device can be faster and more convenient; however, this still has some non-ideal defects. For example, processing of the main disk includes processing of the peripheral annular groove, a diametrical groove receiving the engaging latch and a surface slot for positioning the control knob, manufacturing of it is more troublesome and inconvenient.

SUMMARY OF THE INVENTION

The object of the present invention is to provide a key collecting device being controlled on one end thereof, the device largely simplifies the structure of such kind of key collecting devices to make processing and assembling of them more convenient.

To obtain the object, the present invention is provided on the main body thereof with a central hole extending upwardly from the bottom thereof to get a specific depth, the central hole has in the inner end thereof a conical hole connecting to a reduced diametrical hole communicating with the upper end of the main body; and a transverse hole with a specific diameter extends through the reduced diametrical hole for connecting and mounting an annular ring having a notch for mounting and detaching. A movable latch is matchably placed in the inner hole of the main body, and is provided with a through hole having a size same as that of the transverse hole. A fixing block is fixedly connected with the inner bottom end of the central hole of the main body, and a spring is mounted between the bottom surface of the movable latch and the upper end of the fixing block under a pressure. The spring under the pressure makes the movable latch normally press against the conical hole to make the through hole get out of the ways of the transverse hole but get in the notch of the annular ring, so that partial length of the movable latch is exposed out of the end surface of the main body for controlling by pressing for mounting and detaching the keys.

The present invention will be apparent in the novelty as well as the features thereof after reading the detailed description of the preferred embodiments thereof in reference to the accompanying drawings.

DETAILED DESCRIPTION OF THE PREFERRED EMBODIMENT

Figure 1:
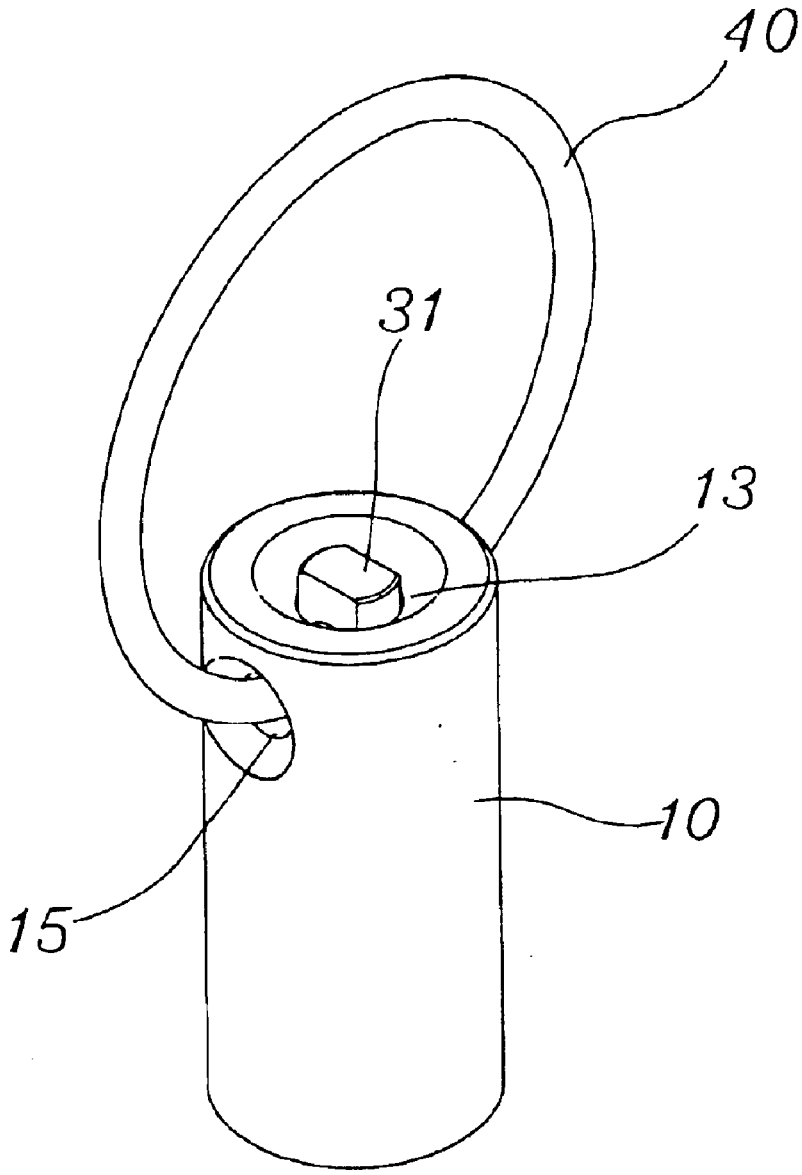
FIG. 1 is a perspective view of a preferred embodiment of the present invention.

Referring to FIG. 1, the present invention has a main body 10 which is cylindrical in the embodiment shown, but we can see from the detailed specification below that, it can also be any shape convenient for carrying such as a rectangular block.

Figure 2:
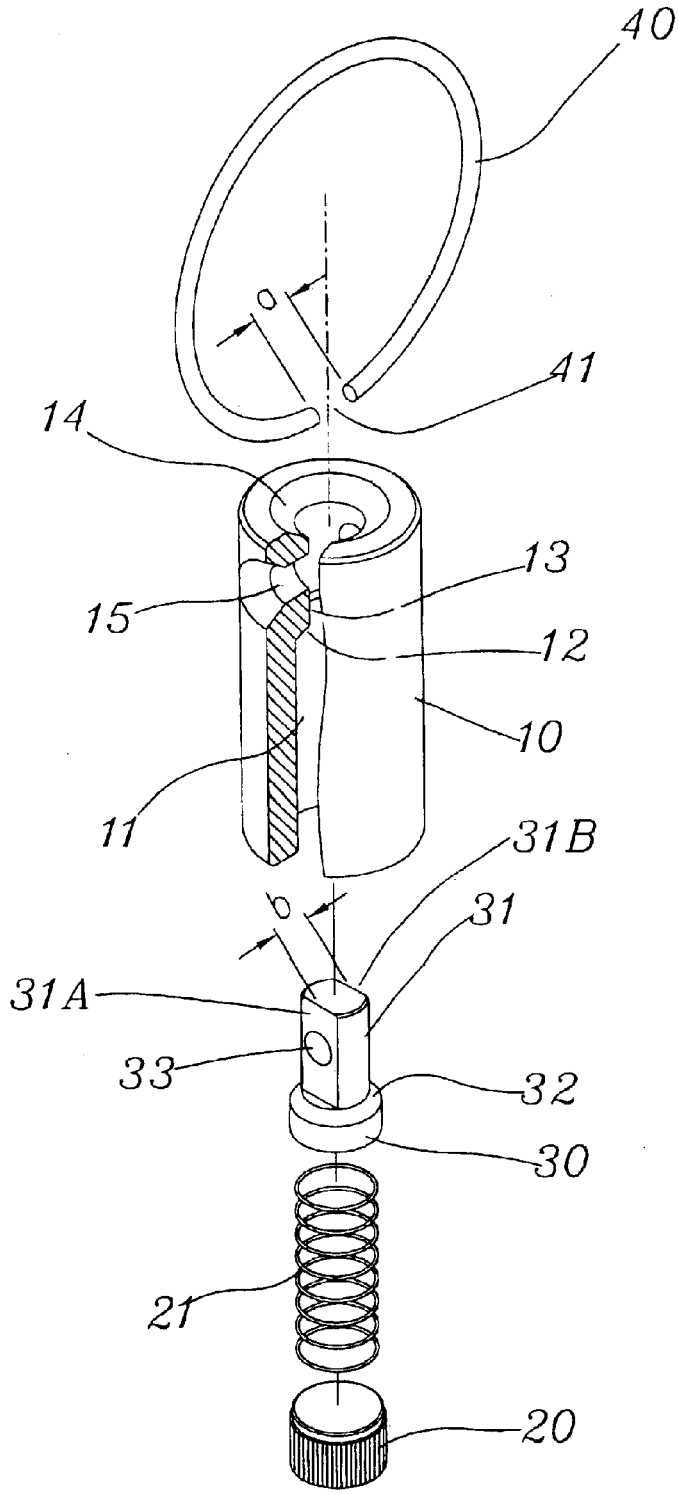
FIG. 2 is an analytic perspective view showing the elements of FIG. 1.
Figure 3:
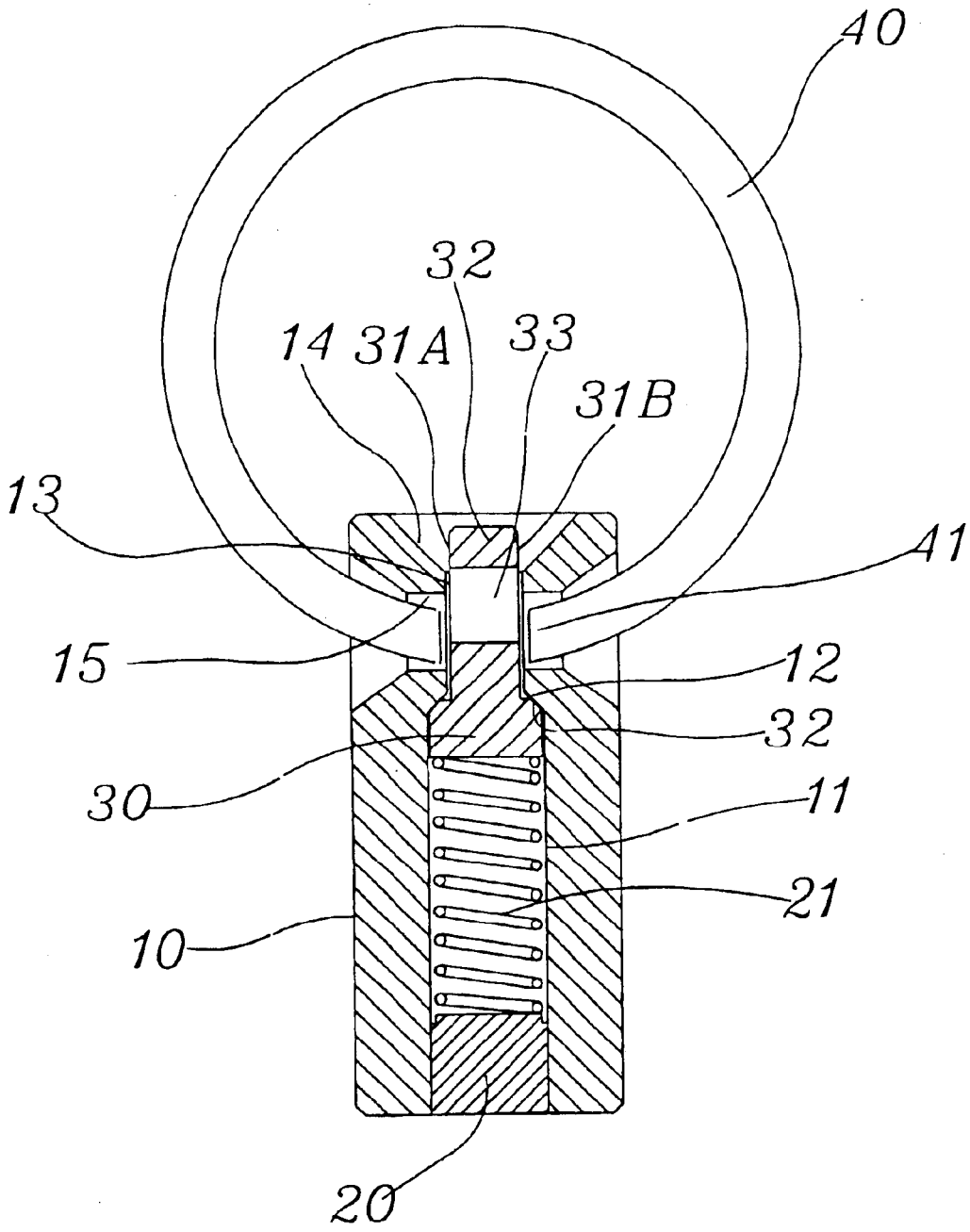
FIG. 3 is a sectional view taken from FIG. 1.

Referring to FIGS. 1–3, the main body 10 is provided with a central hole 11 extending upwardly from the bottom thereof to get a specific depth, the central hole 11 has in the inner end thereof a conical hole 12 connecting to a reduced diametrical hole 13 communicating with the upper end of the main body 10. In the preferred embodiment shown, the reduced diametrical hole 13 is connected on the top end thereof with an enlarged conical hole 14 communicating with the upper end of the main body 10. And a transverse hole 15 with a specific diameter extends through the reduced diametrical hole 13.

The central hole 11, the conical hole 12 and the reduced diametrical hole 13 stated above and arranged in a same central line are provided sequentially upwardly from below with a fixing block 20, a spring 21 and a movable latch 30. An annular ring 40 with a notch 41 is connected by insertion with the transverse hole 15; the notch 41 used as an access for mounting and detaching the keys has a specific width "a".

The diameter of the shank of the above stated movable latch 30 is slightly smaller than that of the central hole 11, it can thereby be inserted into the central hole 11 for forwarding and retracting; it is further provided with reduced shank portion 31 in coincidence with the diameter of the reduced diametrical hole 13, the reduced shank portion 31 is provided on the two lateral sides thereof with planed surfaces 31A, 31B respectively, the distance "b" between the planed surfaces 31A, 31B is smaller than the width "a" of the notch 41. The junction of the movable latch 30 and the shank has a tapered surface 32 in mating with the conical hole 12; and a through hole 33 having the same size as that of the transverse hole 15 is provided on the reduced shank portion 31.

The above stated fixing block 20 is fixedly connected with the inner bottom end of the central hole 11; and the spring 21 is mounted between the bottom surface of the movable latch 30 and the upper end of the fixing block 20 under pressure. In fixed connection of the fixing block 20, the tension force of the compressed spring 21 will push against the movable latch 30, so that the tapered surface 32 of the movable latch 30 normally presses against the conical hole 12. The through hole 33 gets out of the way of the transverse hole 15, so that partial length of the movable latch 30 is exposed out of the reduced diametrical hole 13, at this time, the device is in a closed state.

Figure 4:
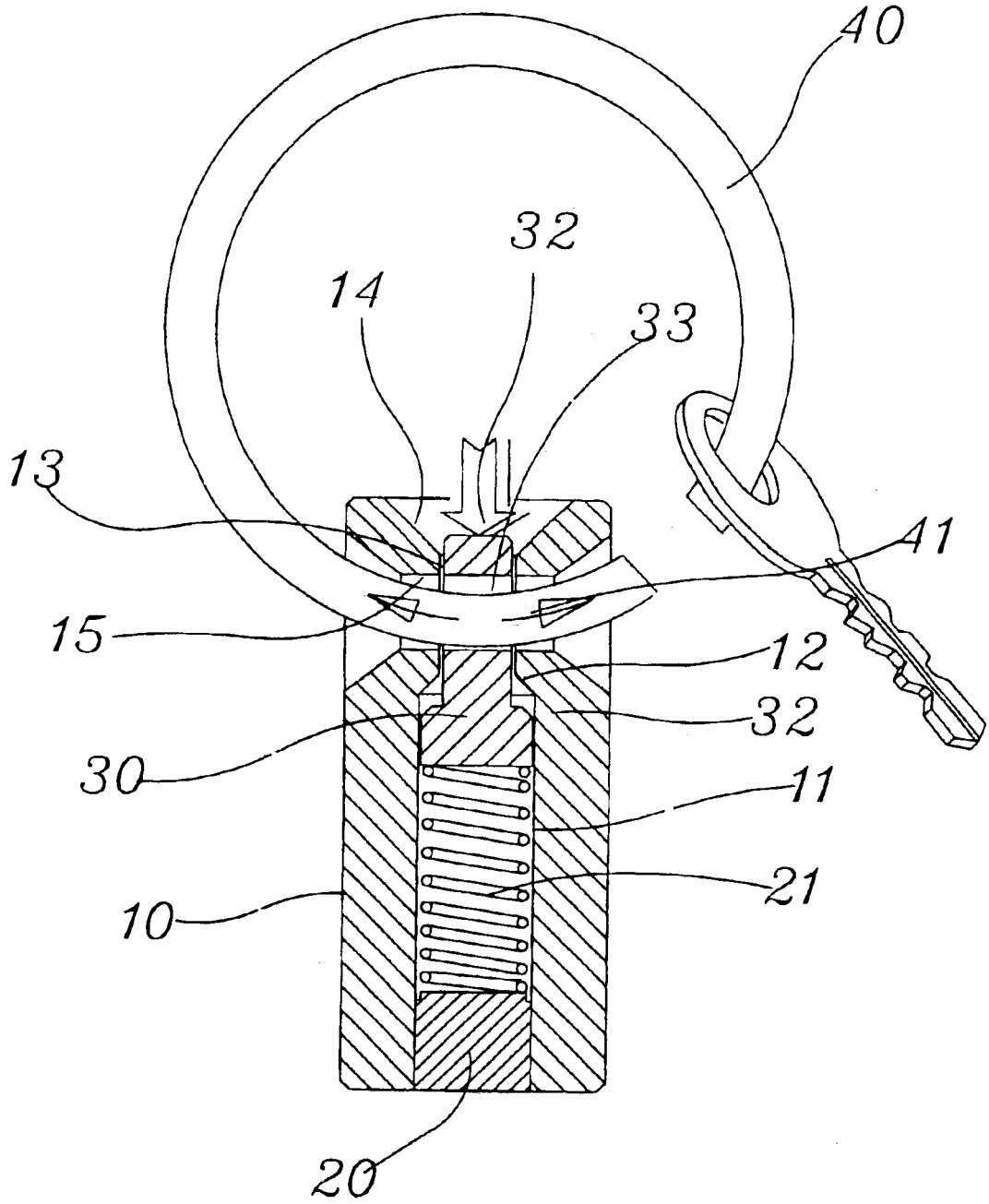
FIG. 4 is a schematic view showing operation of the present invention as shown in FIG. 3.

As shown in FIG. 4, when the end portion of the main body 10 presses the exposed portion of the movable latch 30, the bottom surface of the movable latch 30 will compress the spring 21 in the central hole 11 to make the whole movable latch 30 descend. When the through hole 33 of the movable latch 30 reaches the transverse hole 15 of the main body 10 and is aligned with it, the annular ring 40 restrained from turning originally can be rotated freely, so that the notch 41 provided can be rotated out of the main body 10. The articles to be collected such as keys can be placed in and collected through the notch 41. By the fact that the width "a" of the notch 41 on the annular ring 40 is slightly larger than the distance "b" between the planed surfaces 31A, 31B, when the annular ring 40 having rotated out is turned back reversely to the original position thereof, the elastic restoring force of the spring 21 being compressed will rebound to its normal closing position to complete the operation of collecting the articles to be collected such as keys. On the contrary, when the collected articles are to be detached, the above stated steps can be repeated as is shown in FIG. 4, and the collected articles can be taken out.

Figure 6:
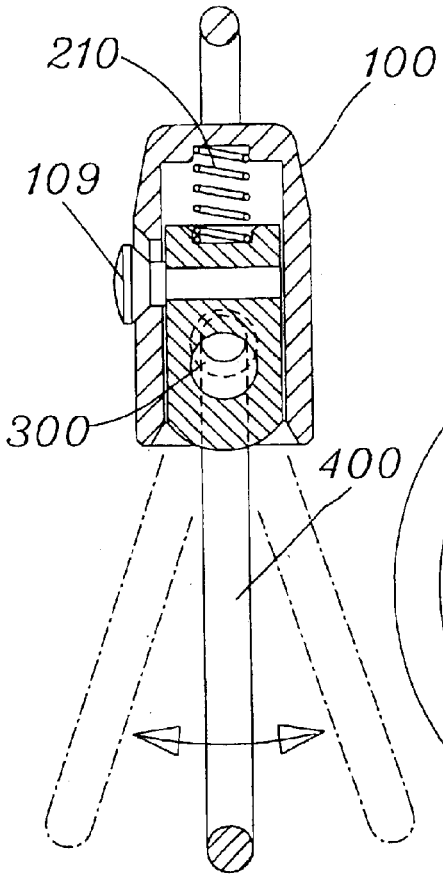
FIG. 6 is a sectional side view taken from FIG. 5.
Figure 5:
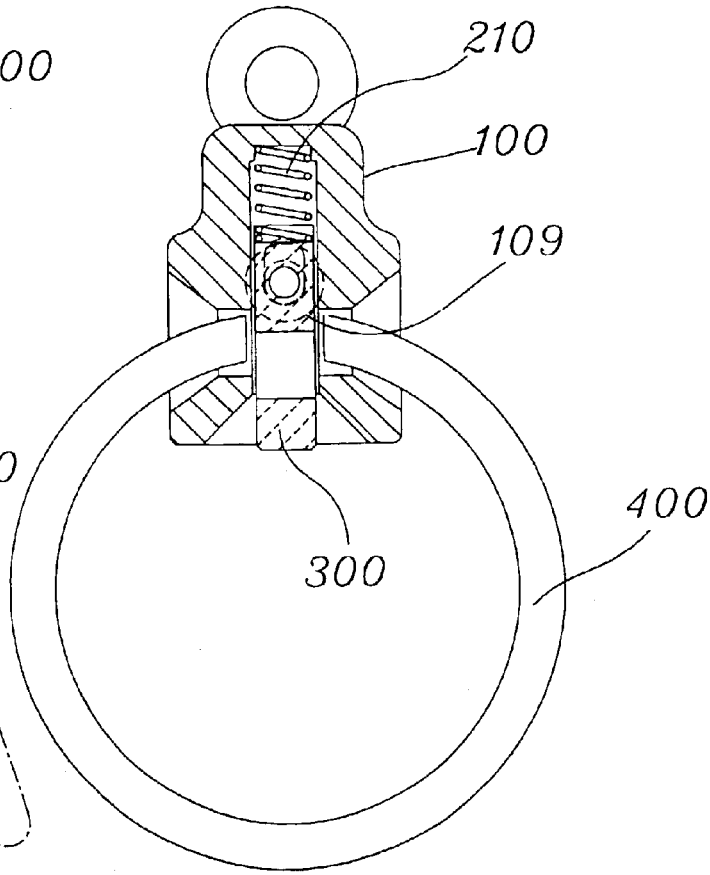
FIG. 5 is a front sectional view of a second embodiment of the present invention.

In another embodiment of the present invention as shown in FIGS. 5 and 6, a main body 100 with a different shape is similarly provided therein with a movable latch 300 and a spring 210 having the same operative structures as those of the previous embodiment. The movable latch 300 normally is pressed in the main body 100, pressing can also be applied on the exposed end of the movable latch 300. This embodiment is further provided on a lateral surface of the main body 100 with a push button 109; the push button 109 is linked up with the movable latch 300. Namely, an annular ring 400 is also controlled by opening and shutting of a notch for mounting and detaching keys by control of the push button 109.

Figure 7:
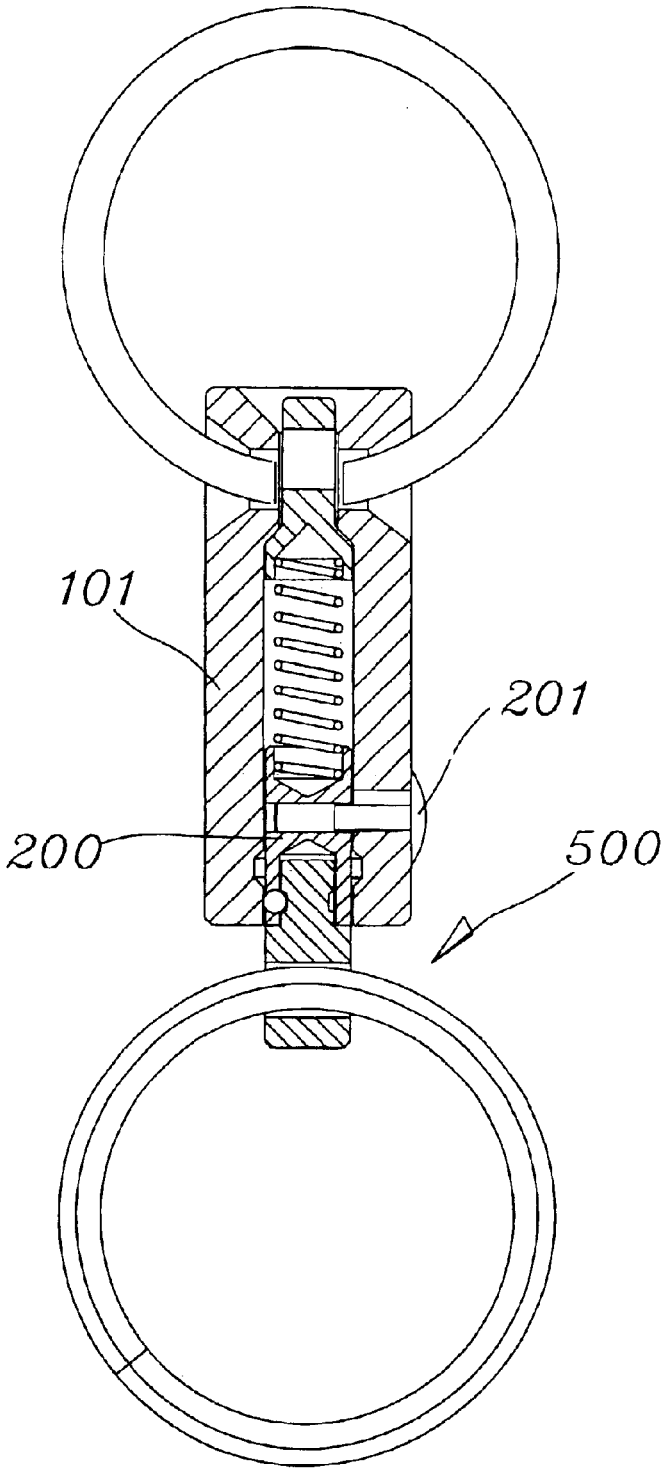
FIG. 7 is a front sectional view of a third embodiment of the present invention.
Figure 8:
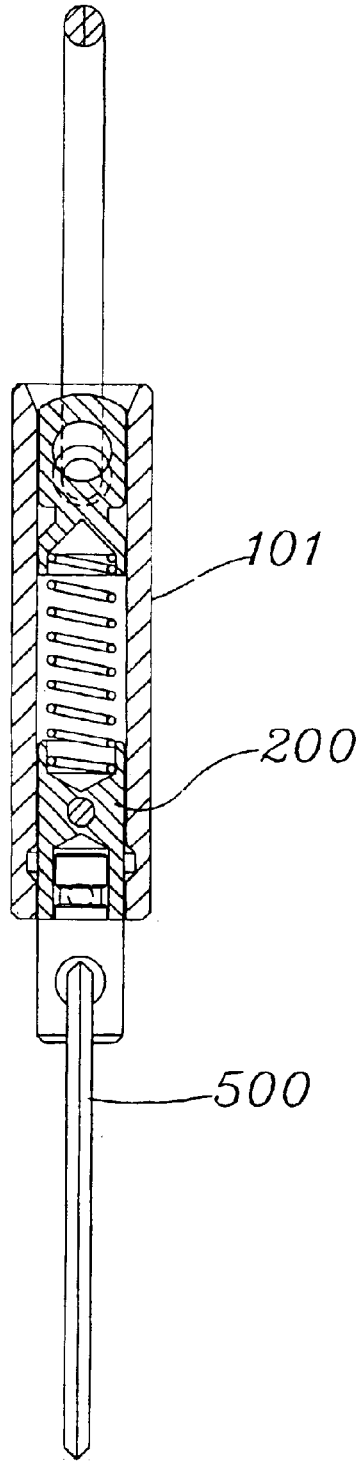
FIG. 8 is a sectional side view taken from FIG. 7.

In a further embodiment of the present invention as shown in FIGS. 7 and 8, a main body 101 with a further different shape is similarly provided therein with a movable latch and a spring having the same operative structures as those of the previous embodiments; and pressing can also be applied on the exposed end of the movable latch. However, a fixing block 200 can be mounted in cooperation with a positioning pin 201 to get a different type of key collecting device to thereby increase the scope of application of the device.

Figure 9:
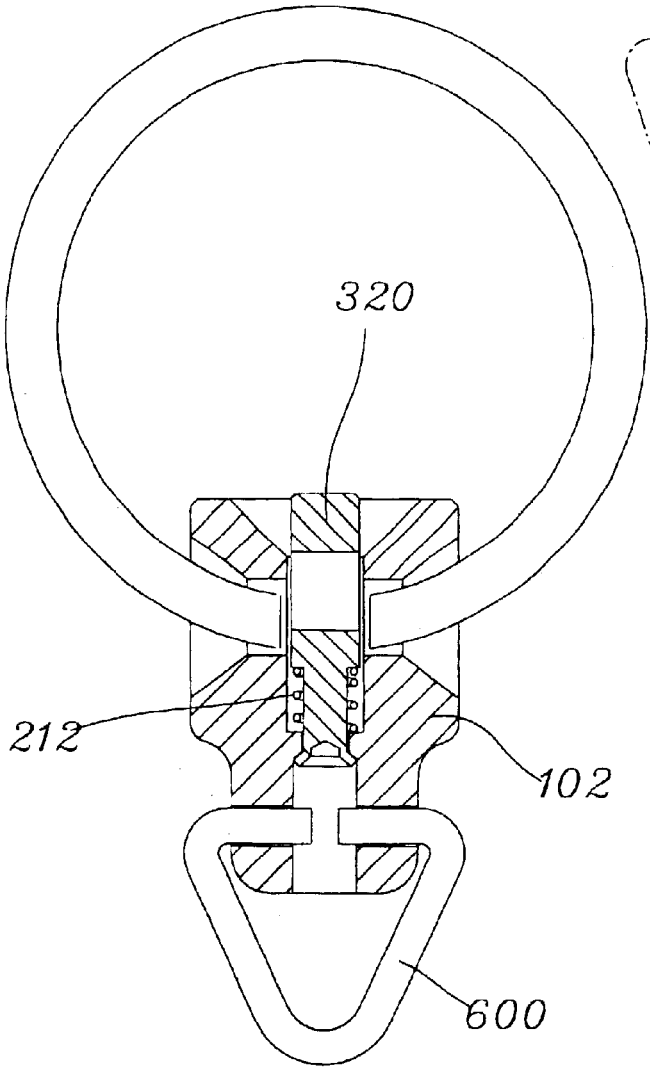
FIG. 9 is a front sectional view of a fourth embodiment of the present invention.
Figure 10:
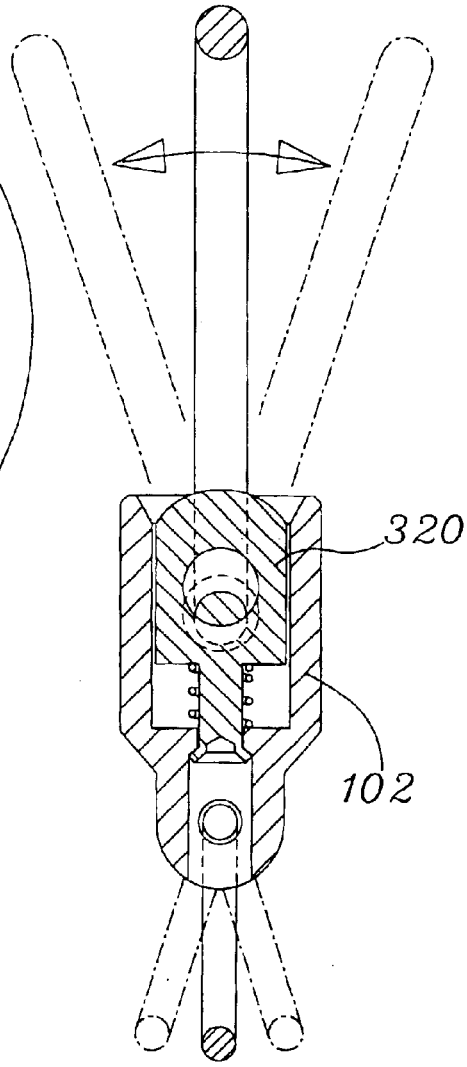
FIG. 10 is a sectional side view taken from FIG. 9.

In another embodiment of the present invention as shown in FIGS. 9 and 10, a main body 102 with a further different shape is similarly provided therein with a movable latch 320 and a spring 212, the bottom end of the spring 212 is positioned on the inner upper surface of a step portion of the main body 102; and the main body 102 has a section of a predetermined length for mounting a triangular accessory 600.

Figure 11:
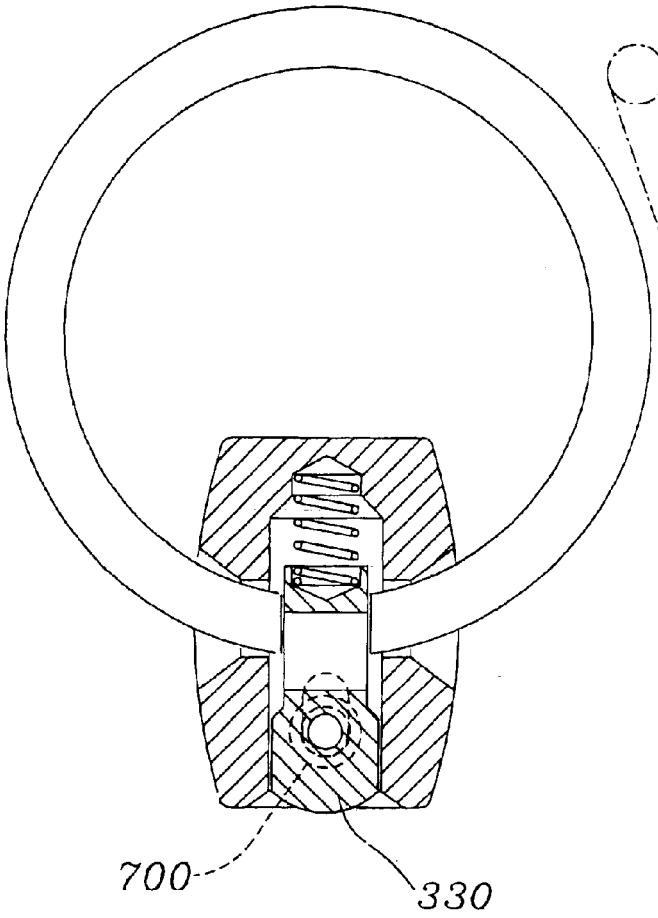
FIG. 11 is a front sectional view of a fifth embodiment of the present invention.
Figure 12:
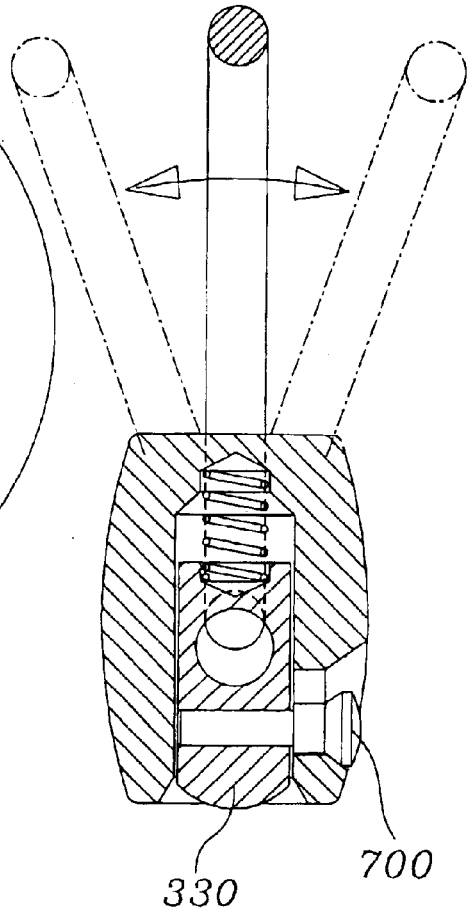
FIG. 12 is a sectional side view taken from FIG. 11.

In an embodiment of the present invention as shown in FIGS. 11 and 12, a movable latch 330 normally under pressure in a main body is controlled by linking up with a lateral push button 700.

Figure 13:
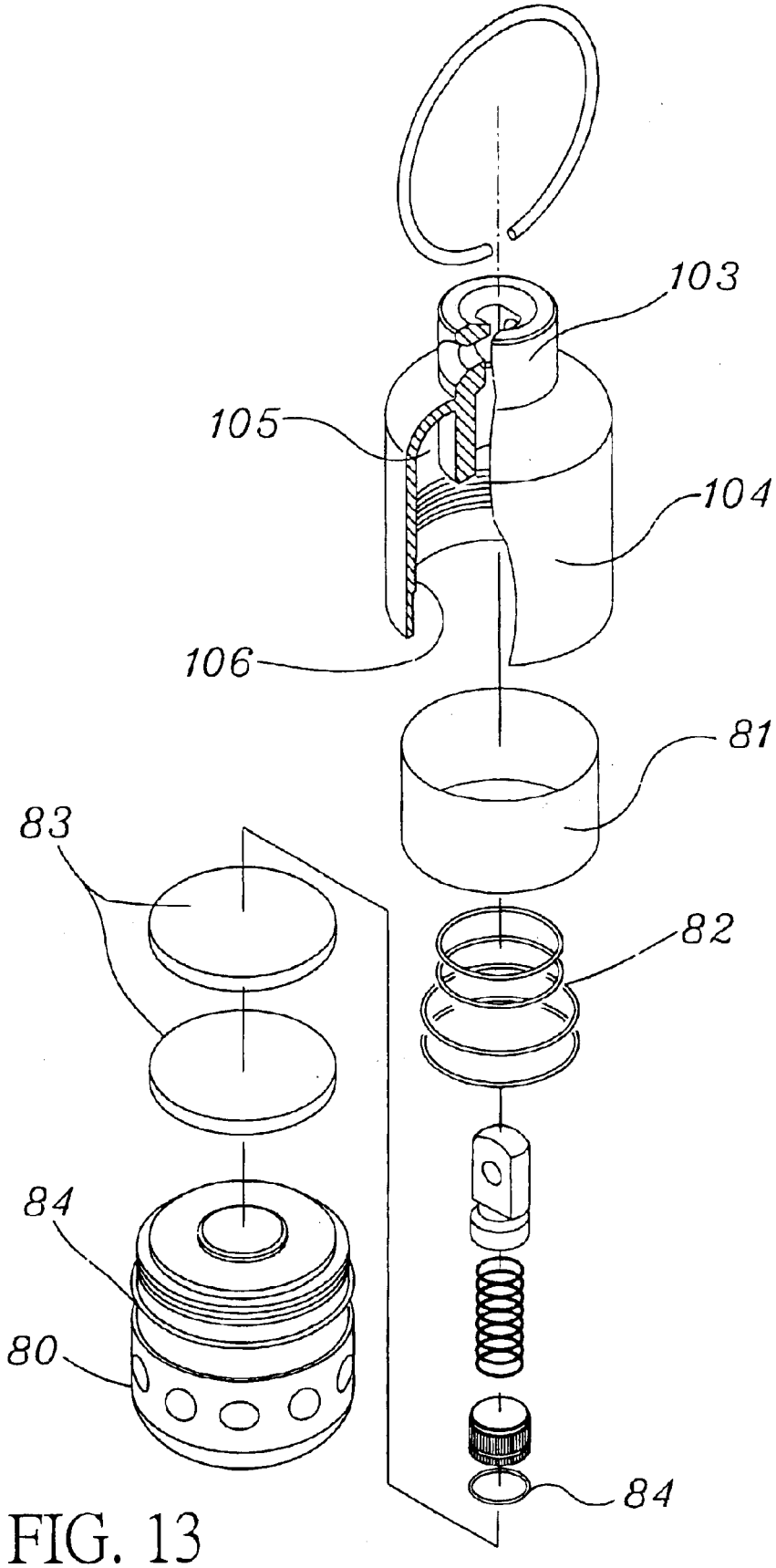
FIG. 13 is an analytic perspective view showing the elements of a sixth embodiment of the present invention.
Figure 14:
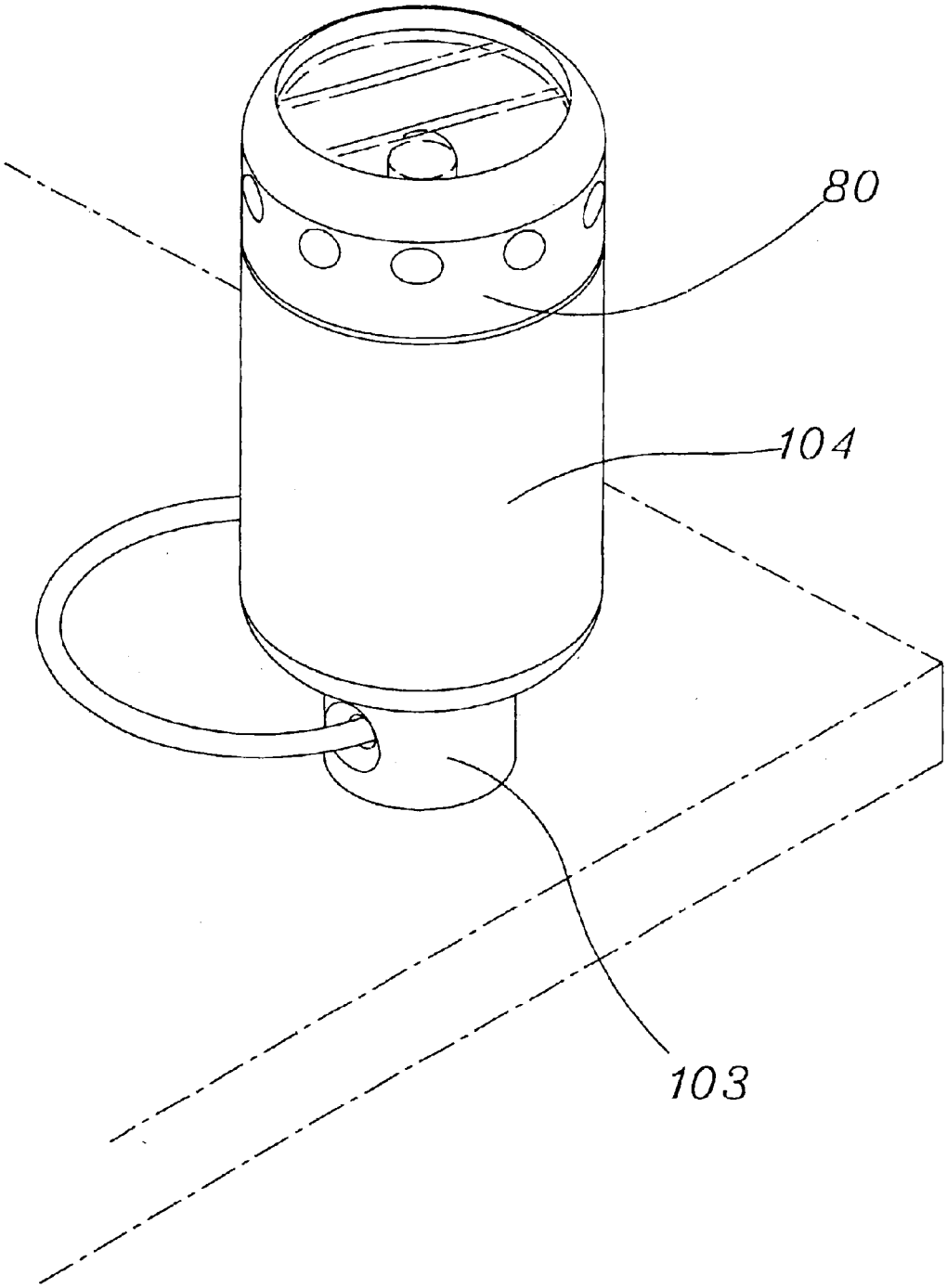
FIG. 14 is a perspective view showing assembling of the embodiment of FIG. 13.
Figure 15:
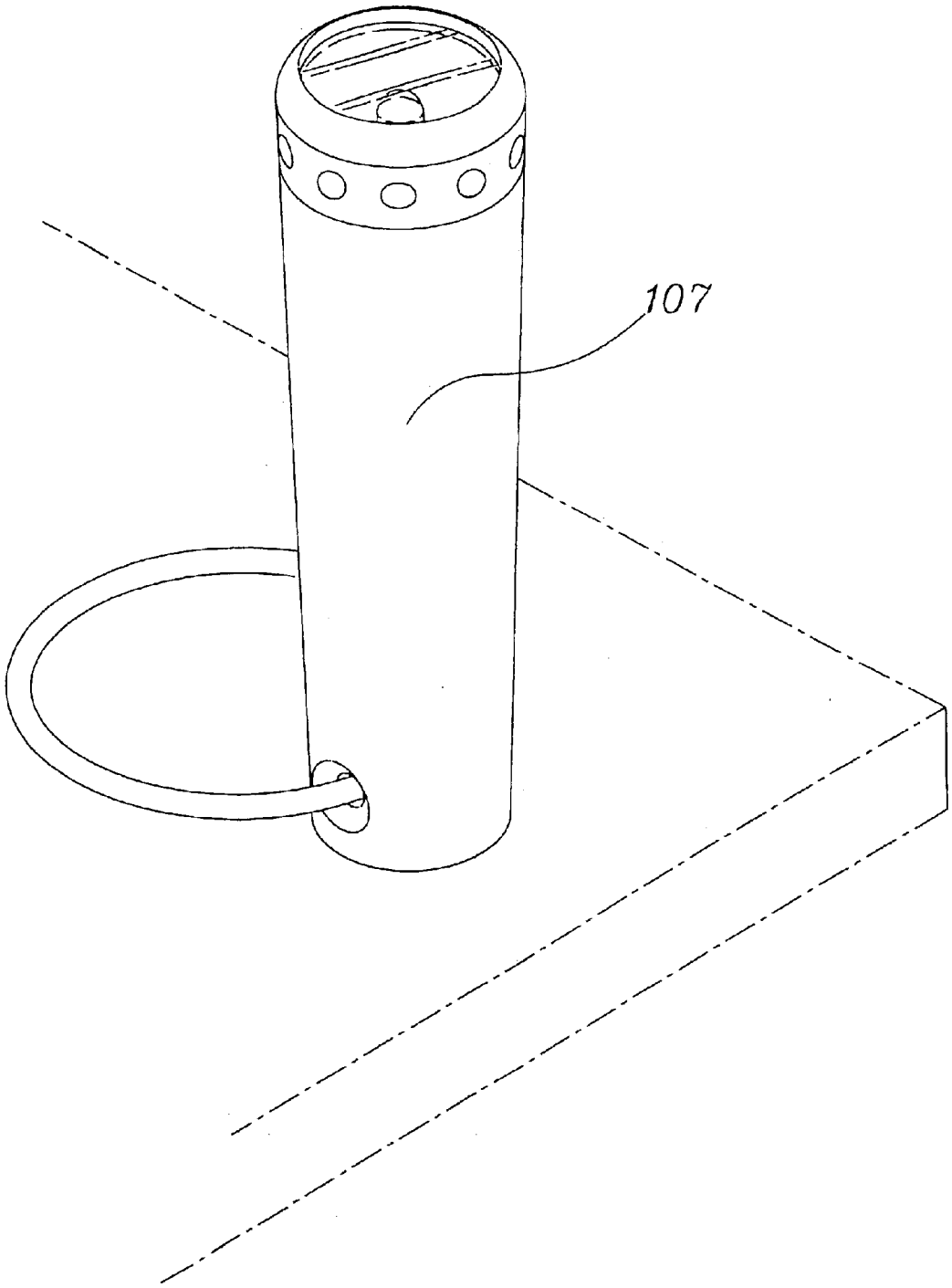
FIG. 15 is a perspective view of a seventh embodiment of the present invention similar to that of FIG. 14.

In a sixth embodiment of the present invention as shown in FIGS. 13 and 14, a main body 103 is similarly provided therein with a movable latch, a spring and a fixing block having the same operative structures as those of the previous embodiments; and pressing can also be applied on the exposed end of the movable latch. The main body 103 is provided with a skirt like portion 104, a receiving recess 105 is formed between the two parts and an inner threaded portion 106 is provided near the lower end of the skirt like portion 104. The embodiment thereby can be mounted therein with a miniaturized flashlight 80 lightened by an LED. The space formed by the skirt like portion 104 can be placed therein an insulation collar 81 and an electric conductive spring 82, a battery set 83 used as a power supply is provided beneath the fixing block. The device is to be used as an article carried on one's person, some locations thereon can be provided with waterproof rings 84. The embodiment shown in FIG. 15 is similar to the sixth embodiment of the present invention as shown in FIGS. 13 and 14 except that, the embodiment has the skirt like portion 107 thereof elongated for convenience of holding in using the entire device as a flashlight.

It can be seen from the above stated embodiments that the most important thing of the entire key collecting device of the present invention is, the structure of the main body is quite simplified, nearly there are only thee central hole, the conical hole and the reduced diametrical hole conical hole on the same central line, thereby processing of the device is fast, and such key collecting device can be quite fast and convenient in manufacturing as well as assembling, and especially suits the mass production process in a factory with low cost, it surely has the industrial application value.

The embodiments described are only for illustrating the present invention, and not for giving any limitation to the scope of the present invention. It will be apparent to those skilled in this art that various modifications or changes can be made to the elements of the present invention without departing from the spirit of this invention, all such modifications and changes also shall within the scope of the appended claims.

What is claimed is:

1. A key collecting device being controlled on one end thereof, said device comprising: a main body which is provided with a movable latch positioned normally by extending and abutting of a spring, a transverse hole with a specific diameter extends through said main body for connecting and mounting an annular ring having a notch for mounting and detaching of keys; said movable latch is provided with a through hole having a size same as that of said transverse hole, said through hole normally is under pressure to get out of the way of said transverse hole but get in said notch of said annular ring, so that partial length of said movable latch is exposed out of the end surface of said main body for controlling by pressing, wherein said main body is provided with a central hole extending upwardly from the bottom thereof to get a specific depth, said central hole has in the inner end thereof a conical hole connecting to a reduced diametrical hole communicating with the upper end of said main body; said transverse hole extends through said reduced diametrical hole for mounting said annular ring; said movable latch is in a shape in mating with said reduced diametrical hole and said conical hole; a fixing block is fixedly connected with the inner bottom end of said central hole of said main body, and the spring is mounted between the bottom surface of said movable latch and the upper end fo said fixing block under a pressure.

2. The key collecting device as claimed in claim 1, wherein , said movable latch is provided on the two lateral sides thereof with two planed surfaces, the distance between said planed surfaces is smaller than the width of said notch of said annular ring.

* * * * *